US005248225A

United States Patent [19]

Rose

[11] Patent Number: 5,248,225

[45] Date of Patent: Sep. 28, 1993

[54] INSULATING DRAINAGE METHOD AND DIVERTER FOR BUILDING FOUNDATIONS

[76] Inventor: William B. Rose, 207 W. Iowa St., Urbana, Ill. 61801

[21] Appl. No.: 931,065

[22] Filed: Aug. 17, 1992

[51] Int. Cl.[5] ..... E02B 11/00; E02D 19/00

[52] U.S. Cl. ..... 405/229; 52/169.5; 405/36; 405/38

[58] Field of Search ..... 405/43, 45, 229, 38, 405/36, 48, 49, 52; 52/169.5, 169.14

[56] References Cited

U.S. PATENT DOCUMENTS

| | | | |
|---|---|---|---|
| 3,304,672 | 2/1967 | Bakke | 52/169.5 |
| 4,142,344 | 3/1979 | Palmaer | 52/169.5 X |
| 4,745,716 | 5/1988 | Kuypers | 405/45 X |
| 4,869,032 | 9/1989 | Geske | 405/43 X |
| 4,877,350 | 10/1989 | DiFiore | 405/43 X |

OTHER PUBLICATIONS

Labs, et al., "Building Foundation Design Handbook," Underground Space Center, Univ. of Minn., May 1988, pp. 133-134.

W-8 Engineering Print, "Water Cut-Off Mastic Grid System," Carlisle Corporation, 1991.

W-9 Engineering Print, "Vertical Terminations," Carlisle Corporation, 1991.

*Primary Examiner*—Dennis L. Taylor

*Attorney, Agent, or Firm*—Silverman, Cass & Singer, Ltd.

[57] ABSTRACT

A method and device for diverting water away from a building foundation and insulating the soil surrounding the foundation. The method includes excavating a trench in the soil at least about a portion of the perimeter of a new or existing building foundation, the trench having a predetermined depth, a first side wall defined by the building foundation, a bottom surface defined by the soil having a predetermined slope extending away from the building foundation a predetermined distance and a second side wall opposite the first side wall and defined by the soil. A first insulated waterproof diverter member is placed within a portion of trench for diverting water away from the foundation and reducing the frost penetration depth within the soil surrounding the foundation. The diverter member includes a first portion positioned against the foundation defining the first side wall of the trench and a second portion positioned against the bottom surface of the trench and sloping outwardly away from the first side wall to a position proximate the second side wall. A readily installable, removable and substantially waterproof connecting member is provided for connecting the diverter member to the foundation, preventing water flow between the diverter member and the foundation and enabling removal of the connecting member to allow access to the foundation for inspection purposes and filling the trench above the diverter member with soil to a desired level.

2 Claims, 4 Drawing Sheets

Fig. 5
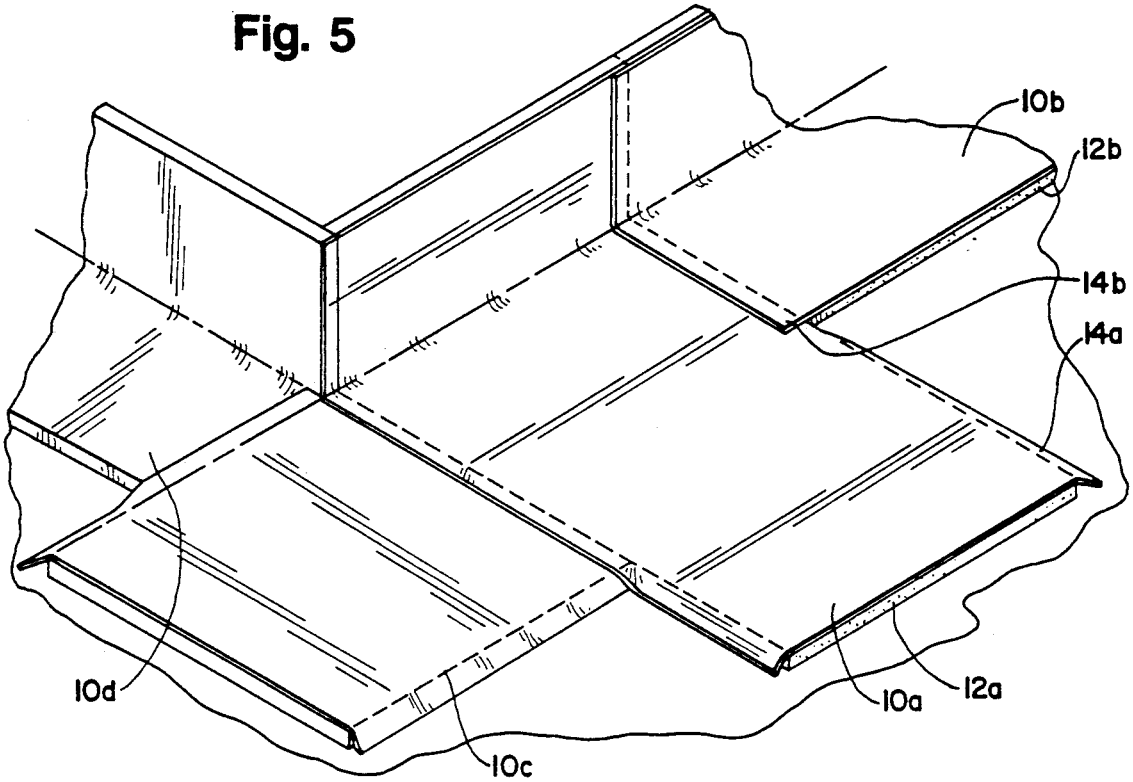
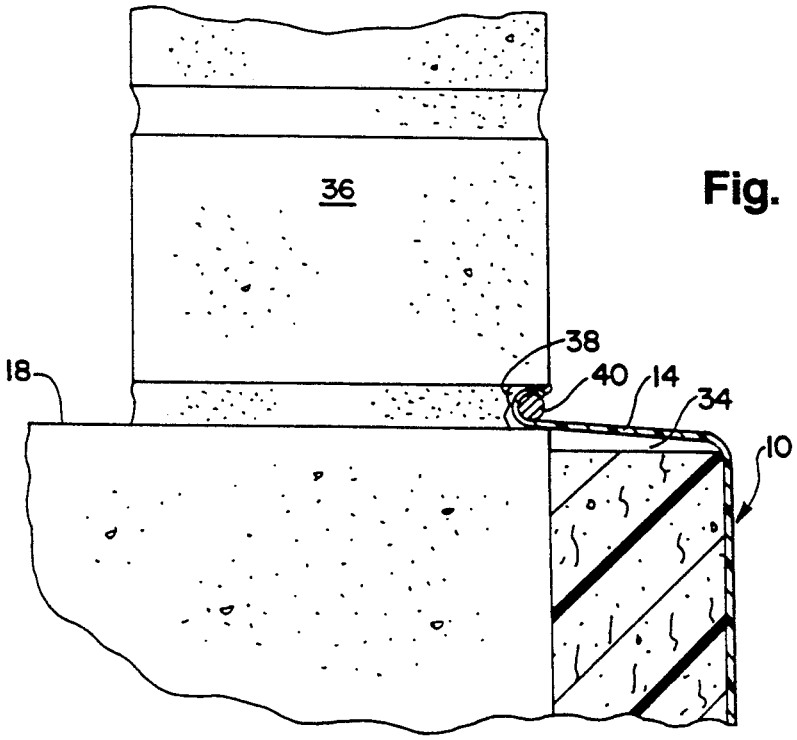
Fig. 6

INSULATING DRAINAGE METHOD AND DIVERTER FOR BUILDING FOUNDATIONS

BACKGROUND OF THE INVENTION

1. Field of the Invention

This invention relates generally to a method and diverter for directing water away from a building foundation, and more particularly, to a method and diverter which keeps the soil about the foundation dry, reduces the frost penetration depth in the soil about the foundation, can be installed about new or existing foundations and readily provides access to a portion of the foundation for inspection.

2. Description of the Related Art

Due to potential health concerns, high levels of humidity within a building or home are undesirable. For example, high levels of humidity significantly contribute to the growth of many microorganisms, such as dust mites, mold and mildew, all of which may produce allergens, toxins and irritants and produce unwanted odors.

Additionally, high humidity can cause serious damage to the structure and contents of a building. For example, wall and ceiling finishes can turn black from mold, which also can grow in clothes and bedding. Fungi can grow in building cavities, paint finishes can peel prematurely and window frames and sills can deteriorate.

Humidity within a building can originate from many sources including breathing, showering, cooking, cleaning, plants and clothes dryer discharge into the living space. The largest and most damaging source of moisture, however, is a wet foundation which typically is attributed to rainwater.

To provide desirable levels of moisture, a structure must be properly ventilated and the source of moisture, typically rainwater, must be reduced as much as possible. Once the soil close to the foundation becomes wet it is very difficult to keep the basement or crawl space defined by the foundation dry and, in turn, the remainder of the building or house.

Existing building practices stress the importance of controlling moisture but typically rely only on venting to relieve excess accumulations. Venting alone, however, does not provide enough moisture reduction. Additionally, newer buildings and homes are built to be "tighter" in order to reduce heating and cooling costs and drafts. These newer "tighter" buildings, however, reduce moisture within a building at a much slower rate.

Rainwater typically originates from the direct rainfall on and about a structure as well as from runoff from surrounding lots and structures which may be uphill from a particular structure. This rainwater can be diverted away from the structure to a surface or sub-surface or "sub-grade" drainage system. With a surface system, the type of soil utilized should be relatively impermeable and graded to a visible slope away from the structure which typically is at least one-half inch per foot. With a sub-surface system the rainwater typically is drained to a buried pipe which must remain unclogged and effective whether it drains to a sump pump, municipal storm system or ambient atmosphere.

Even under ideal diverting conditions, some water can accumulate in the soil surrounding a structure. Thus, in addition to venting and diverting, foundation walls typically are "damproofed" with a coating of bitumen and/or a layer of plastic placed beneath the concrete floor slab to retard movement of water vapor into the building. Furthermore, as a backup, a sump pump often is installed to collect and discharge any water that may accumulate in the soil or gravel beneath the floor slab. Such methods, however, are not effective when the soil surrounding the foundation is saturated.

Dry soil about a foundation also contributes to energy savings within the building. Dry soil about a foundation adds considerable R-value to the foundation since dry soil is a thermal resistor and wet soil is a thermal conductor.

Three structural problems also can be reduced or eliminated by maintaining dry soil about the foundation. The first is "frost heave" which is the swelling of wet soil when it freezes. Frost heave may occur beneath or against the foundation and actually can lift parts of the building. Although heat loss through a foundation sometimes can maintain the soil thereabout above freezing temperatures, it is preferable to keep the soil dry so as also to save energy costs through heat loss reduction.

The second structural problem is the swelling of the soil. This, especially, is a problem in regions having clay in soils since when clay becomes wet it exerts enormous pressure on foundations sufficient to cause distortion.

Finally, a widespread problem appears as horizontal cracking in foundation walls and occurs when soil surrounding a foundation goes from very dry to very wet. When dry, the soil shrinks and creates vertical crevices between the soil and the foundation. Debris then accumulates in the crevices and, after the next rainfall, the soil swells back to its original position with the addition of the debris. Over time, this causes the foundation wall to bulge and eventually crack, typically in a horizontal direction. In any event, dry soil or at least soil with a stable moisture content virtually eliminates all of these problems.

In attempting to provide dry soil about a building foundation, current building practice employs a combination of construction techniques based on building codes, traditional practices and new products. Building codes often require specific soil slope and footing drains, vapor retarders in walls and ventilation in attics and living and crawl spaces.

Traditional building practices vary from region to region. A standard practice for most areas typically includes footing drains surrounded by gravel and connected to a sump pump, a gravel base and plastic barrier beneath the floor slab, and damproofing of the foundation walls.

For foundation walls, it is increasingly common to provide a vertical drainage barrier having a filter attached to drainage board. The filter is a water permeable membrane or fabric which permits water to enter into the drainage board constructed of a material which provides vertical drainage to a subgrade pipe or tiles. Such barriers, however, require excavation to the bottom of the foundation, depend on the successful operation of the footing drains, easily can overload the footing drain and can become clogged.

One construction solution to water problems within a structure is a de-watering system. Such a system typically creates openings through the foundation walls permitting water to enter the structure and then directing water to a sump pump through an interior gutter system. Such systems not only permit the foundation to become wet, thereby incurring the various mold and structural problems discussed above but place an even greater dependence on the proper operation of the sump pump and its associated power system.

In order to divert water away from a building foundation and insulate the surrounding soil to reduce the frost penetration level, it also is known to provide rigid insulation about the exterior of a building foundation. An example of such a method is disclosed in BUILDING FOUNDATION DESIGN HANDBOOK, Kenneth Labs, et al., prepared by the Underground Space Center, University of Minnesota, 1988, pp. 65, 67 and 132–136. Those pages illustrate several slab-on-grade insulation placements as well as a horizontal "flowerbed" retrofit application having rigid insulation firmly adhered against a portion of the foundation and sloping away into the soil a predetermined distance. Although such rigid insulation can include a protection board, coating or flashing on one surface thereof, such a coating only is provided on a portion of the vertical section in contact with the foundation wall. Additionally, except for the adhesion between the insulation and the foundation, no specific connections are disclosed.

It therefore would be desirable to provide a method and diverter for keeping the soil about the foundation of a building dry which also reduces the frost penetration level within the soil, readily can be installed to new and existing structures, provides waterproof connections between adjacent diverters and between the diverter and the building wall which readily can be removed and reinstalled to allow inspection of the foundation.

SUMMARY OF THE INVENTION

The invention provides a method and device for diverting water away from a building foundation and insulating the soil surrounding the foundation against frost penetration. The method includes excavating a trench in the soil at least about a portion of the perimeter of a new or existing foundation. The trench is formed to a predetermined depth and includes a first side wall defined by the foundation, a bottom surface defined by the soil having a predetermined slope extending away from the foundation a predetermined distance and a second side wall opposite the first side wall and defined by the soil. A first insulated waterproof diverter member is placed within a portion of the trench for diverting water away from the foundation and reducing the frost penetration depth within the soil surrounding the foundation. The diverter member includes a first portion positioned against the foundation defining the first side wall of the trench and a second portion positioned against the bottom surface of the trench and sloping outwardly away from the first side wall of the trench to a position proximate to the second side wall of the trench. A readily installable, removable and substantially waterproof connecting member is provided for connecting the diverter member to the foundation, preventing water flow between the diverter member and the foundation and enabling removal of the connecting member to allow access to the foundation for inspection purposes and filling the trench above the diverter member with soil to a desired level.

BRIEF DESCRIPTION OF THE DRAWINGS

FIG. 5 is a perspective view of several diverters positioned about a corner of the foundation wall and extending within the trench illustrating the positioning about the corner;

FIG. 6 is an enlarged cross-sectional view of a portion of the building foundation and wall of a structure illustrating the connection between a diverter panel and a brick wall;

DESCRIPTION OF THE PREFERRED EMBODIMENTS

Figure 1:
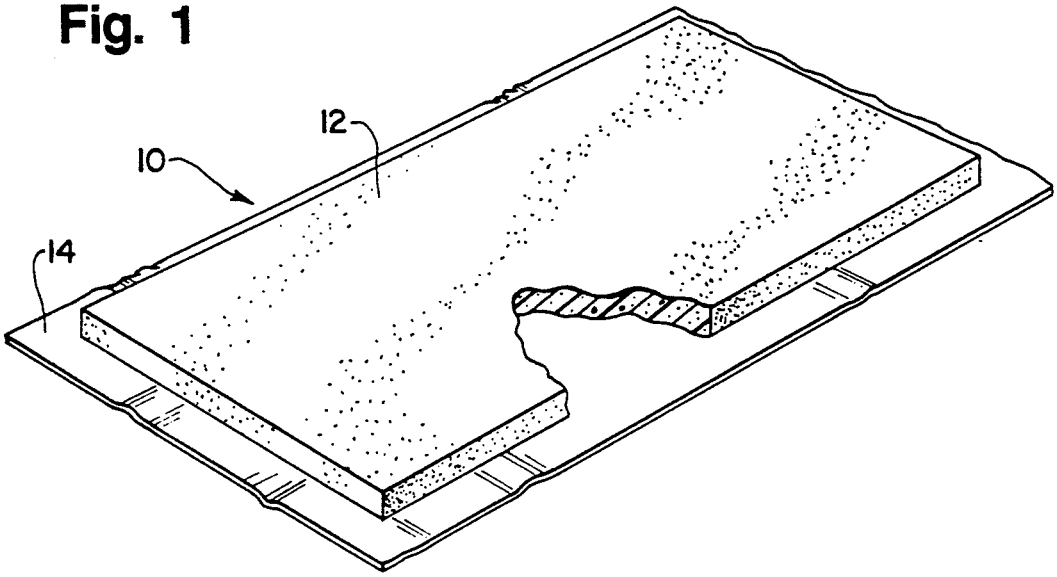
FIG. 1 is a perspective view of the diverter of the invention illustrating the insulated panel and waterproof membrane connected thereto.

Referring to FIG. 1, the diverter of the invention is designated generally by the reference numeral 10. The diverter 10 preferably is rectangular in shape and includes an insulating panel 12 and a waterproof membrane 14 secured to one planar face of the panel 12.

Briefly, in use, the diverter 10 is a water impermeable device having an L-shaped profile which is installed around the perimeter of a building foundation. Thus, the diverter 10 functions as an umbrella and an extension of the roof to keep the soil below the diverter 10 from being saturated with water. It reduces the frost penetration depth in the soil, thereby reducing many structural problems caused by frost. By diverting water away from the building foundation the diverter 10 shields the soil about the foundation against water.

Preferably, the panel 12 is a semi-rigid panel which can be scored and cut with a utility knife. It is composed of an expanded or extruded foam insulation material or a mineral fiber product with suitable binders and having a thickness of approximately 1.5 inches (38.1 mm) and a predetermined R value. The dimensions of the panel 12 preferably are four foot by eight foot (1.219 m by 2.438 m) which is suitable for most residential needs and is of a common size convenient for transport and storage.

The membrane 14 is a waterproof membrane which can be composed of an elastomeric (such as EPDM or PIB), a thermoplastic (such as PVC with plasticizers) or a modified bitumen. The membrane 14 preferably is adhered to one planar side of the panel 12 and, in order to make joints between adjacent panels and the building foundation, extends approximately 3 inches (76.20 mm) beyond the edges of the panel 12 on all four sides of the panel 12. Thus, the membrane 14 has approximate dimensions of four feet six inches (4'6") (1.371 m) by eight feet six inches (8'6") (2.591 m) but can vary and readily can be trimmed and/or notched with a knife or scissors.

To assist in reducing or eliminating pests about the building foundation, the panel 12 and/or the membrane 14 can be treated with a pesticide such as termiticide or the like. Preferably, the panel 12 is a mineral fiber rather than a rigid foam panel and is treated with a pesticide before placement. The membrane 14 covering the panel 12 provides good chemical protection to the building foundation since it prevents the pesticide from being diluted or flushed from the panel 12.

Figure 2:
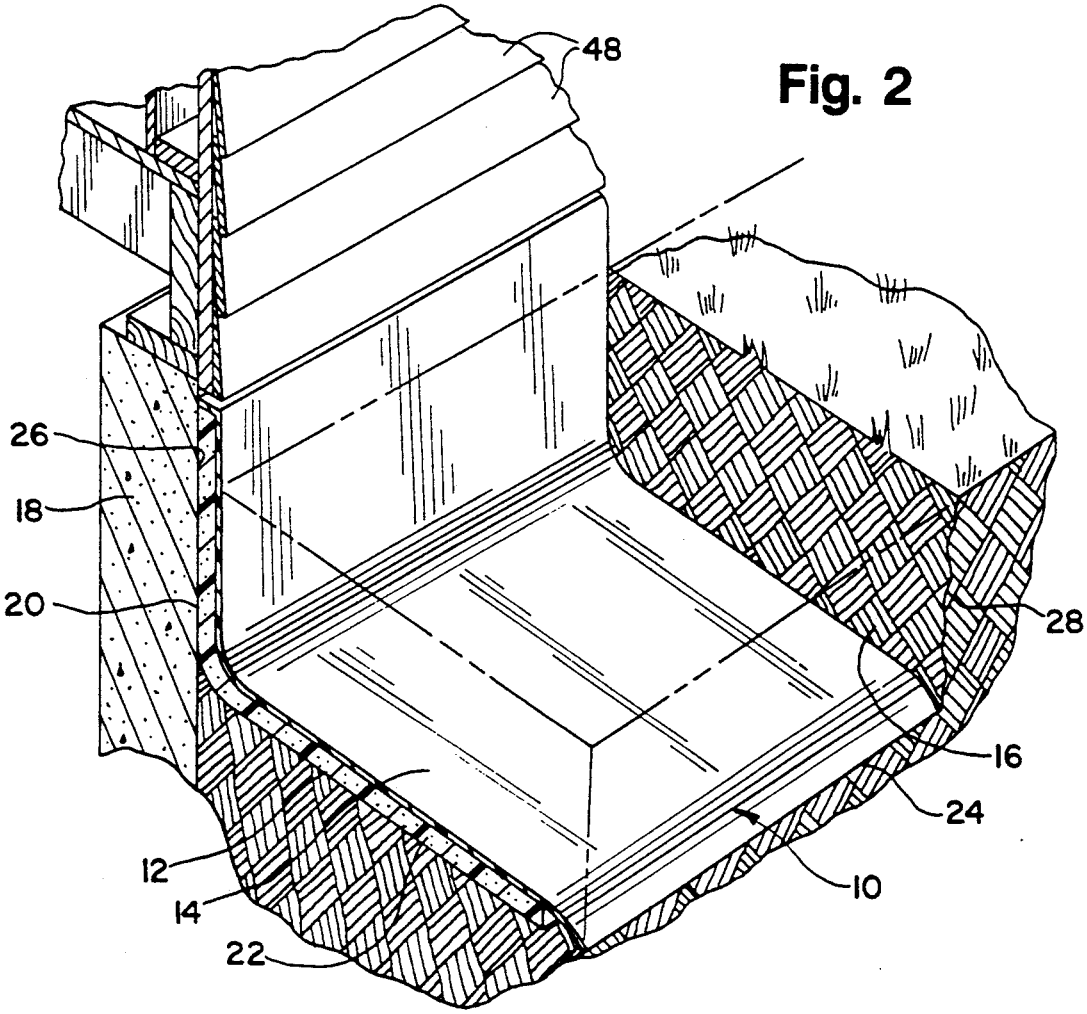
FIG. 2 is a perspective view in partial section of a portion of a trench provided about a building foundation and wall structure and illustrating the diverter in position against the bottom of the trench and the foundation wall.
Figure 3:
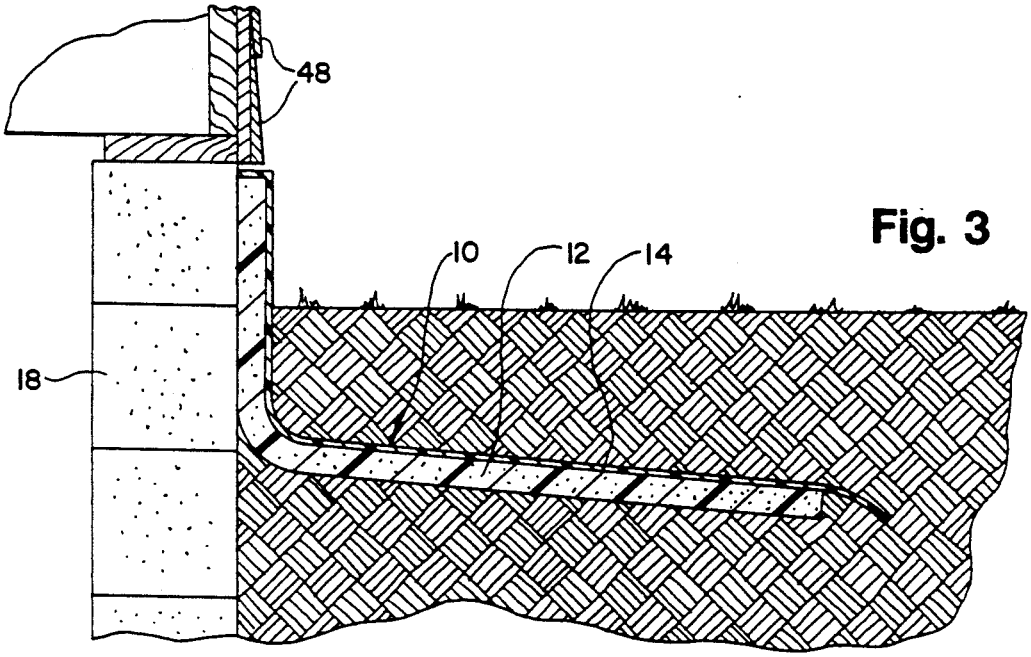
FIG. 3 is a cross-sectional view of the foundation wall and soil thereabout illustrating an embodiment of the diverter in its installed position.

FIGS. 2 and 3 illustrate the preferred placement of the diverter 10. As FIG. 2 illustrates, a trench 16 is provided about the perimeter or desired perimetric portion of a building foundation 18, which is illustrated in FIG. 2 as concrete, but can be cement block as illustrated in FIG. 3, if desired.

As described in detail below, the panel 12 preferably is scored in a desired location so that the diverter 10 can be bent to provide a first planar panel portion 20 which rests against the foundation 18 and a second planar panel portion 22 which is seated along the bottom 24 of the trench 16. The membrane 14 preferably faces upward away from the bottom 24 of the trench 16. It is to be noted that, alternatively, the diverter 10 can be substantially flexible so that it can be bent into the desired L-shape or preformed in the desired L-shape so long as the two panel portions 20 and 22 are provided as described.

Typically, the diverter 10 is placed below grade, with an outwardly extending slope and with the longer dimension of the diverter 10 being positioned against the foundation 18. Accordingly, when a 4'×8' diverter 10 is utilized, the 8 foot dimension is placed against the foundation 18.

The trench 16 is formed to a depth of one foot (0.305 m) at a first side 26 defined by the foundation 18, but could be placed deeper to accommodate root growth of certain plants, if desired. The bottom 24 of the trench 16 extends at a slope of at least ½ inch per foot (12.70 mm per 0.305 m), and preferably is 1 inch per foot (25.40 mm per 0.305 m), to a distance of approximately 2½ feet (0.762 m) from the foundation 18 and includes a second side 28 defined by the soil at that point.

In order to maintain the basic dimensions of the trench 16 during on-site excavation, a tapered screed (not illustrated) can be utilized having the general dimensions of the trench 16. The screed can be roughly constructed from lumber and utilized in conjunction with a level to assure a relatively smooth, uniform outward slope. Additionally, the exposed surface of the foundation 18 forming the first side 26 of the trench 16 should be brushed clean before installation of the diverter 10.

Figure 4:
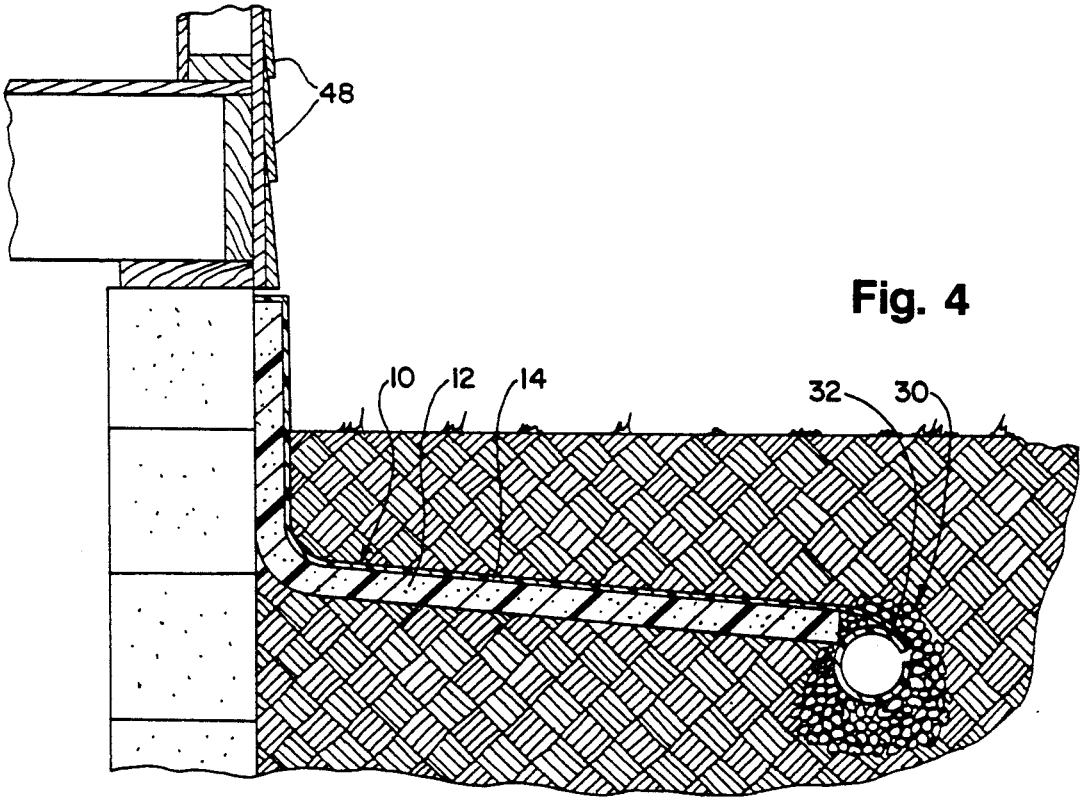
FIG. 4 is a cross-sectional view, similar to FIG. 3, illustrating another embodiment of the diverter in its installed position and in conjunction with a drainage pipe or tile system.

As FIG. 4 illustrates, if desired, a collector trench 30 can be cut at an outer edge 32 of the trench 16. The collector trench 30 can be part of a positive drainage system, incorporating a French drain or piping to a suitable outlet. It is to be understood, however, that the diverter 10 can be utilized without the collector trench 30.

Figure 7:
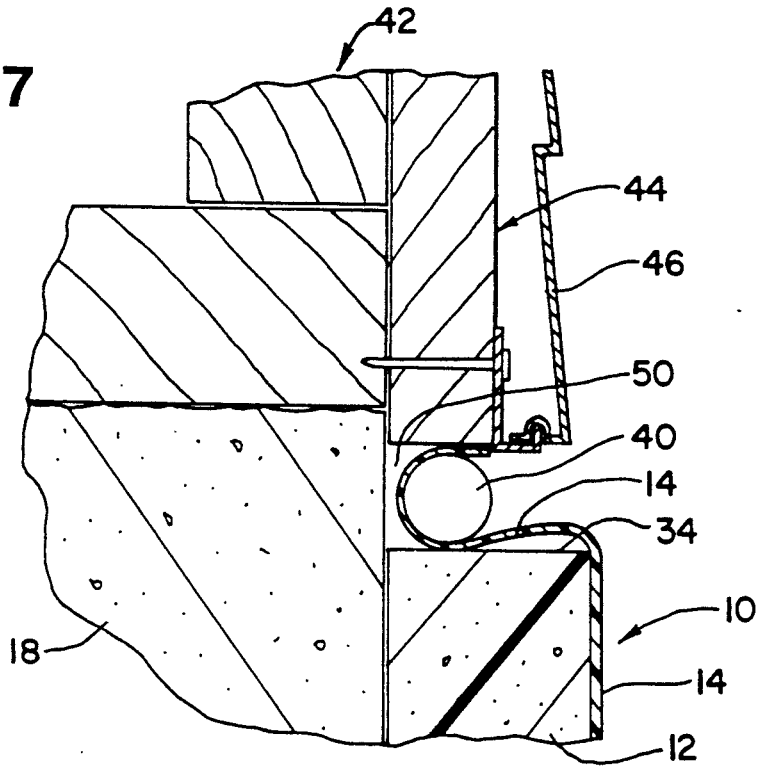
FIG. 7 is an enlarged cross-sectional view, similar to FIG. 6, illustrating the connection between a diverter panel and a wooden wall with siding.
Figure 8:
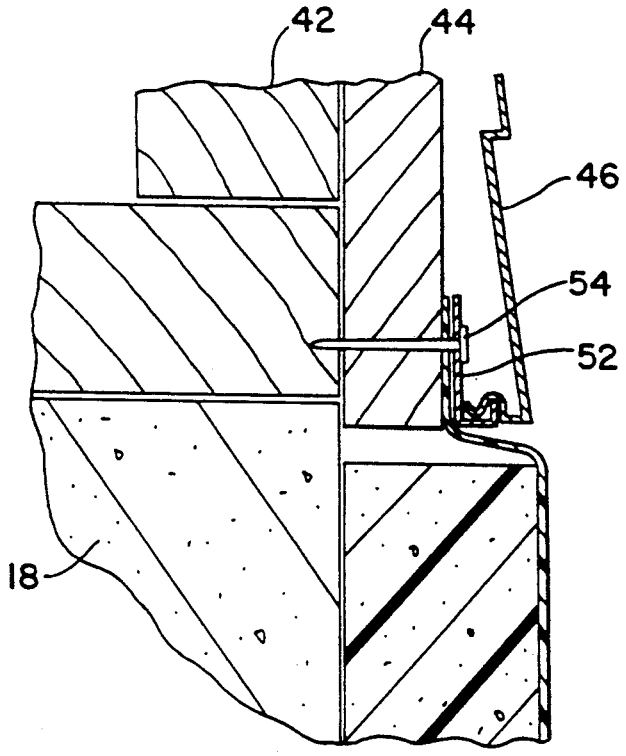
FIG. 8 is an enlarged cross-sectional view, similar to FIG. 7, illustrating another connection between the diverter panel and a wooden wall with siding.

FIGS. 6, 7 and 8 illustrate the different types of substantially waterproof connections for use with the present invention and which can be established between the diverter 10 and the building. FIG. 6 illustrates a substantially waterproof connection between the foundation 18, a brick or block wall 36 formed atop the foundation 18 and a top portion 34 of a diverter panel 10. A gap 38 is provided between the foundation 18 and the wall 36, preferably beneath the weep holes (not illustrated) and is raked in the brick mortar to a depth of approximately ½" (12.70 mm). The membrane 14 along the top 34 of the diverter 10 then is tucked into the gap 38 and held in place with a backer rod 40. Preferably, the gap 38 is approximately ¾" (19.05 mm) wide and the backer rod 40 is slightly larger than the gap 38 and formed from a resilient material, such as foam or the like, but can vary.

Accordingly, the connection substantially is waterproof due to the placement of the membrane 14 and prevents water from entering between the diverter 10 and the foundation 18. It is to be noted that slight leakage between the diverter 10 and the foundation 18 is inconsequential. If desired, however, the connection provided by the membrane 14, gap 38 and backer rod 40 can be completely sealed, such as by an adhesive, fasteners, melting or the like. Additionally, not only is the connection readily and easily provided with a minimum of parts and labor, but the backer rod 40 can be removed and the membrane 14 pulled back from the foundation 18 so as to allow inspection of the foundation 18 for structural integrity and pest control, etc.

FIG. 7 illustrates a similar connection of the membrane 14 utilizing the backer rod 40 with a typical wood frame wall 42 and corresponding sheathing 44 having siding 46 connected thereto which also can be utilized with clapboards 48 (illustrated in FIGS. 2–4) in place of the siding 44. In this embodiment, a gap 50 is provided between the top 34 of the diverter 10 and the sheathing 44 and the backer rod 40 holds the membrane 14 in place as in the embodiment of FIG. 6.

FIG. 8 illustrates a connection of the membrane 14 without a backer rod 40. In this embodiment, the membrane 14 can be placed beneath a siding starter strip 52 which then is secured by fasteners 54, such as nails or the like. The siding 46 then is connected to the starter strip 52. It is to be noted that this can be accomplished either during initial construction or after construction is completed merely by removal and reinstallation of the starter strip 52 with the membrane 14 secured beneath the starter strip 52. Additionally, if clapboards 48 are utilized, the membrane 14 merely is placed between the sheathing 44 and the bottom clapboards 48 and the clapboards 48 then are fastened with nails 54 (not illustrated).

FIG. 5 illustrates both the connection between adjacent diverters 10 and a reinforced corner placement of diverters 10. The typical connection between two adjacent diverters **10*a* and 10*b* is a tuck-and-lap joint where the membrane 14*a* of the diverter 10*a* is tucked beneath the panel 12*b* and the membrane 14*b* is positioned or lapped over the membrane 14*a* and panel 12*a*. Since slight leakage at this point is inconsequential, the joint preferably is not sealed. Alternatively, the joint can be completely sealed, such as with an adhesive or double sided tape or the membrane 14** can be provided with an adhesive layer, melted, heat shrunk or the like.

Both inside and outside corners of the foundation 18 readily can be protected by appropriate placement and/or cutting of a diverter 10. For an inside corner, a single diverter 10 can be cut, notched and folded to a desired shape or two diverters 10 can be properly mitered (not illustrated). For an outside corner, two diverters 10 converging from the adjacent sides of the foundation 18 can be mitered. Alternatively, a diverter **10*c* can be cut into a square shape to be placed between the converging diverters 10*a* and 10*d***.

Since downspouts typically are positioned at building corners, it may be desirable to provide the foundation about a corner having a downspout with the diverter **10*a* arranged for extra protection against water penetration. This can be accomplished by turning the diverter 10*a* so that the longer or 8 foot dimension extends away from the foundation 18 to provide an extension of the sloped horizontal projection of the diverter 10***a*.

To install the diverters 10 about the foundation 18, the trench 16 first is provided with the desired dimensions. Next, the panel 12 of a diverter 10 is longitudinally scored or cut approximately 1 foot from one of its longer 8 foot edges and only half way through the panel 12. The diverter 10 then is placed in the trench 16, membrane 14 side up, and bent along the score line. To hold the diverter in place during the remainder of the assembly, a weight or a few shovels of backfill can be placed on the diverter 10. To maintain the top 34 of the diverter 10 in its desired position to provide the gap 50 or in alignment with the gap 38, a temporary shim can be utilized.

The remaining installation procedure can progress in a variety of ways. First, proceeding with one diverter 10 at a time, the backer rod 40 can be inserted to attach the over-hanging portion of the membrane 14 to the building. The trench 16 then is filled with soil to a desired layer except proximate to the tuck-and-lap joint with a consecutive diverter 10. The next diverter 10 then is similarly positioned in the trench 16, connected to the previous diverter 10 and to the building and then covered with soil except along its 4 foot edge for further diverter connection.

Alternatively, a desired number or all of the consecutive diverters 10 can be placed in the trench 16 and joined along their 4 foot edges. Then, the backer rod 40 is positioned to hold each diverter 10 and the trench 16 is filled with soil or vice versa.

In any event, installation is continued until all of the desired diverters 10 are in place, properly connected to the building and each other and the trench 16 is filled with soil.

Thus, the diverter 10 can be utilized for existing and new construction of residential, commercial or rural structures having either concrete, block, brick or wood foundations and wood, aluminum, vinyl, brick and block exterior finishes. The diverter 10 can be placed for protection of a basement, crawl space, slab foundation, patio, porch, sidewalk, driveway, flower bed or a combination thereof and in hot, cold and temperate climates.

Modifications and variations of the present invention are possible in light of the above teachings. Therefore, it is to be understood that within the scope of the appended claims, the invention may be practiced otherwise than as specifically described.

I claim:

1. A method of diverting water away from a building foundation and insulating both the foundation and the soil surrounding the building foundation, comprising:

a) excavating a trench within the soil at least about a portion of the perimeter of a new or existing building foundation, said trench having a predetermined depth, a first side wall defined by said building foundation, a bottom surface defined by the soil having a predetermined slope extending away from said building foundation a predetermined distance and a second side wall opposite said first side wall and defined by the soil;

b) providing a first insulated waterproof rectangular diverter panel having a substantially rigid insulating panel and a waterproof membrane connected to at least a first planar surface thereof, said membrane over-hanging all four perimetric edges of said rigid panel a predetermined distance;

c) scoring only said rigid panel on a second planar surface thereof opposite said first surface at a predetermined position to separate said rigid panel into first and second portions while said waterproof membrane remains intact to form a hinge between and interconnect said first and second portions;

d) rotating said first portion of said rigid panel about said hinge to form a desired angle with respect to said second portion;

e) placing said first diverter panel within a portion of said trench for diverting water away from said building foundation and insulating the building foundation as well as the soil to reduce the frost penetration depth within the soil surrounding said building foundation, said first portion of said rigid panel being positioned against said building foundation defining said first side wall of said trench and said second portion of said rigid panel being positioned against said bottom surface of said trench and sloping outwardly away from said first side wall of said trench to a position proximate said second side wall of said trench;

f) connecting the overhanging membrane on an end of said first portion of said rigid panel opposite said score line to said building to prevent water flow between said diverter panel and said building foundation and enable removal and reconnection of said overhanging membrane to allow access to said building foundation for inspection purposes;

g) repeating steps b)-f) with at least a second insulated waterproof rectangular diverter panel substantially identical to said first diverter panel and positioned adjacent thereto in said trench;

h) overlapping and sealing the overhanging membranes between said first and second diverter panels to provide a waterproof seal therebetween; and i) filling said trench above said first and second diverter panels with soil to a desired level.

2. A diverter panel for deflecting water away from a building foundation and insulating both the building foundation and the soil surrounding a new or existing building foundation, comprising:

an insulated waterproof rectangular diverter panel formed from a substantially rigid insulating panel having a waterproof membrane connected to at least a first planar surface of said rigid panel, said membrane over-hanging all four perimetric edges of said rigid panel a predetermined distance, said diverter panel being scored only through said rigid panel from a second surface of said rigid panel opposite said first surface having said membrane at a predetermined position thereon to separate said rigid panel into first and second rectangular portions while said waterproof membrane remains intact to form a hinge between and interconnect said first and second portions;

backer rod means for releasably retaining said over-hanging membrane on an end of said first portion of said rigid panel opposite said score line to said building, for preventing water flow between said diverter panel and said building foundation and for enabling ready removal and reconnecting of said connecting means to allow access to said building foundation for inspection purposes; and sealing means for providing a waterproof seal between said over-hanging membrane of said first and second portions of said rigid panel on opposite sides of said rigid panel perpendicular to said score line and a subsequent diverter member placed adjacent said diverter member.

* * * * *